United States Patent [19]

Burk

[11] 4,390,136

[45] Jun. 28, 1983

[54] REPLACEMENT WEAR PINS AND REPLACEABLE IMPELLER ASSEMBLY FOR IMPACT CRUSHER

[76] Inventor: John H. Burk, 712 Charlton Dr., Pleasant Hill, Calif. 94523

[21] Appl. No.: 284,471

[22] Filed: Jul. 17, 1981

[51] Int. Cl.[3] ..... B02C 19/11

[52] U.S. Cl. ..... 241/275

[58] Field of Search ..... 241/188 A, 275, DIG. 10

[56] References Cited

U.S. PATENT DOCUMENTS

| | | | |
|---|---|---|---|
| 1,724,895 | 8/1929 | Beach | 241/188 A |
| 1,857,539 | 5/1932 | Hadsel . | |
| 2,357,843 | 9/1944 | Morrissey . | |
| 2,867,387 | 1/1959 | Dodds et al. . | |
| 2,992,783 | 7/1961 | Wirth et al. . | |
| 3,148,840 | 9/1964 | Behnke . | |
| 3,154,259 | 10/1964 | Behnke et al. . | |
| 3,162,382 | 12/1964 | Danyluke . | |
| 3,170,645 | 2/1965 | Behnke et al. . | |
| 3,174,697 | 3/1965 | Bridgewater . | |
| 3,174,698 | 3/1965 | Miller . | |
| 3,258,211 | 6/1966 | Behnke . | |
| 3,334,823 | 8/1967 | Behnke et al. . | |
| 3,578,254 | 5/1971 | Wood . | |
| 3,652,023 | 3/1972 | Wood . | |
| 3,767,127 | 10/1973 | Wood . | |
| 3,873,047 | 3/1975 | Johnson . | |
| 4,065,063 | 12/1977 | Johnson . | |
| 4,126,280 | 11/1978 | Burk . | |
| 4,166,585 | 9/1979 | Alford et al. . | |

*Primary Examiner*—Mark Rosenbaum
*Assistant Examiner*—Timothy V. Eley
*Attorney, Agent, or Firm*—James R. Cypher

[57] ABSTRACT

An improved impeller and replaceable impeller wear parts for a rock crusher having a turntable driven by a vertical drive shaft. The impeller assembly consists of wear pins, wear plates, and block members and heel plates which are mounted on a removable tray which may be lifted from the turntable as a unit without removing the heavy turntable from the drive shaft. Interchangeable wear pins and wear plates are quickly and easily relocated within the impeller assembly or replaced. The wear pins are characterized by double lugs in the top and bottom of projections in a generally cylindrical metal pin which interlock with cutouts in the wear plates.

4 Claims, 11 Drawing Figures

REPLACEMENT WEAR PINS AND REPLACEABLE IMPELLER ASSEMBLY FOR IMPACT CRUSHER

BACKGROUND OF THE INVENTION

The present invention relates to replaceable wear pin members and a replaceable impeller assembly in impact type crushers.

PRIOR ART

The earliest impact crusher known to Applicant in which rock is fed to a rapidly turning table mounted on a power driven vertical axis is Hadsel, U.S. Pat. No. 1,857,539 granted May 10, 1932. The rock was flung at a high velocity against breaker members positioned around the periphery of the rotating table. The Hadsel table was actually a rectangular chute with the rocks fed through an opening in the center and flung from both ends of the open ended chute. No wear plates were provided to protect the bottom and top of the chute.

Morrissey, U.S. Pat. No. 2,357,843 introduced the circular rotating table and rectangular vanes mounted on radial lines. Feed material moved from the center of the table to the outside edge along a radial straight line path. No buckets were used to throw the feed material from the table.

Dodds, U.S. Pat. No. 2,876,387 teaches the use of replaceable parts in the impeller assembly; recognizing the tremendous abrasion and wear in the impact crusher. No effort, however, was made to alter the straight line radial path of the material as it moved from the center of the table to the periphery.

Wirth, U.S. Pat. No. 2,992,783, improved the efficiency of the impact crusher by installing bucket members on the impeller table so that the feed material was "caught" by the buckets on the periphery of the table and greater speed was imparted to the feed material before being thrown against crusher blocks at high velocity. Wirth also recognized that the feed material became trapped in the buckets so that new feed material slid or rolled across the feed material rather than rubbing against the metal buckets on the impeller wheel. The trailing edge of the bucket was protected by an abrasion resistant channel member. Abrasion of the table was probably rapid since there were no protective wear plates to protect the table and the table could only be rotated in one direction causing rapid wear on one side of the buckets with little or no abrasion on the backside of the buckets.

Behnke, U.S. Pat. Nos. 3,148,840, 3,154,259, 3,170,645 and 3,334,823 teach the use of removable wear pins placed at the head and tail of an L-shaped member. The impeller can only be rotated in one direction thus causing wear on one side of the bucket member. The pins can be individually removed from the impeller wheel but there is no provision for lifting the wear parts of the impeller as a single unit and leaving the heavy lower table attached to the vertical shaft.

Danyluke, U.S. Pat. No. 3,162,386 is another example of a unidirectional table with a different bucket design. When the bucket members are worn, the entire assembly must be replaced. Further, there is no way to remove the impeller without detaching the heavy lower table member from the vertical shaft.

Bridgewater, U.S. Pat. No. 3,174,697, divides his impeller into three (3) basic units; namely, a heavy table which attaches to the rotating hub, a heavy impeller structure which attaches to the table and which contains blades welded to upper and lower disks and to one another, and replaceable buckets which are replaceably attached to the table. When one part of the impeller structure wears out, the entire impeller structure must be replaced.

Miller, U.S. Pat. No. 3,174,698, discloses a rotary breaker pin cage in which the breaker pins are welded between angular plates or are integrally cast with the plates. Wear or destruction of one pin results in the total loss of the breaker pin cage.

Behnke, U.S. Pat. No. 3,258,211, introduced the concept of replaceable wear pins and wear plates. Behnke retained the triangular buckets so that the impeller is unidirectional and welded the buckets to the top and bottom impeller plates so that when one or more buckets received excessive wear, the entire impeller assembly excepting only the wear pins have to be replaced. Behnke does not provide any structure to permit removal of the impeller from the crusher without removing the heavy circular table from the drive shaft. While pins can be replaced without removing the impeller, removal of the impeller and heavy turntable is required to replace the bottom wear plates.

Wood, U.S. Pat. No. 3,578,254 is a bidirectional impeller constructed with reversible and removable triangular shoes. Wood must dismantle his impeller part by part within the rock crusher to replace parts which become worn. If the entire impeller is to be removed as one piece, the heavy bottom turn table must be disconnected from the vertical impeller shaft.

Wood, U.S. Pat. No. 3,652,023, placed spacers between the upper and lower plates to prevent fracturing of the replaceable triangular shoes. To replace worn parts, the impeller assembly must be disassembled within the crusher. No tray unit is provided to remove the impeller from the heavy turn table.

Wood, U.S. Pat. No. 3,767,127, lightened his triangular shoes by providing a fixed triangular post interfitting with a V-shaped shoe. No tray was provided to remove the wear parts of the impeller thus requiring that disassembly be performed within the crusher. As in all of the Wood patents, the rock material abrades the surface of the shoes directly thereby causing greater wear than impellers formed with material filling buckets.

Johnson, U.S. Pat. No. 3,873,047, discloses a highly complicated crusher with vertically reciprocating breaker blocks. The impeller features replaceable hook shaped shoes. In order to replace the worn parts, the impeller must be disassembled within the crusher or the entire impeller including the heavy removable hub and heavy impeller disk must be removed from the vertical drive shaft.

Johnson, U.S. Pat. No. 4,065,063 discloses a unidirectional impeller with impact shoes which impact and break the rock material as well as throw it against the breaker blocks. No build up of material occurs between the impact shoes and the material to be broken. No provision is made for easy removal of the impeller assembly. The impeller must be dismantled piece by piece within the crusher.

Burk, U.S. Pat. No. 4,126,280 utilizes a bi-directional impeller with impeller vanes. No build-up of material occurs between the vanes and the material to be broken. No tray is provided to remove the wear parts from the crusher.

Alford, U.S. Pat. No. 4,166,585 also discloses a bi-directional impeller with impeller vanes. Like Burk, supra there is no build-up of material between the vanes and the material to be broken nor is a tray provided to remove the wear parts from the crusher.

SUMMARY OF THE INVENTION

The present invention provides a single type wear pin which is interchangeable with all pins used in the impeller.

The wear pins are designed so that they be rotated end for end to even the wear.

The wear pins are constructed so that they interlock with the upper and lower wear plates thereby adding to the structural integrity of the impeller assembly.

No bolts or other type of fasteners are used to connect the wear pins to the impeller assembly, thereby rendering the adjustment and interchangability of the pins a simple and fast operation.

The unique shape and arrangement of the pins forms an impeller vane which traps and retains rock material thereby preventing direct abrasion of the structure positioning and holding the pins and preventing abrasion of a substantial portion of the pins themselves.

All of the portions of the impeller which are subject to abrasion are mounted on a tray-like structure permitting quick and easy removal from the rock crusher as a single unit without removing the heavy table from the vertical shaft thereby permitting immediate replacement with a new rebuilt impeller resulting in a minimum of down time. The worn impeller can be transported to a shop area for adjustment and replacement of worn parts.

The impeller of the present invention has a minimum of easily replaceable parts resulting in an overall efficiency of operation and minimizing replacement costs.

The wear parts are positioned to protect all structural parts of the impeller and turntable to insure safe operation of the crusher.

DESCRIPTION OF THE PREFERRED EMBODIMENT

Figure 1:
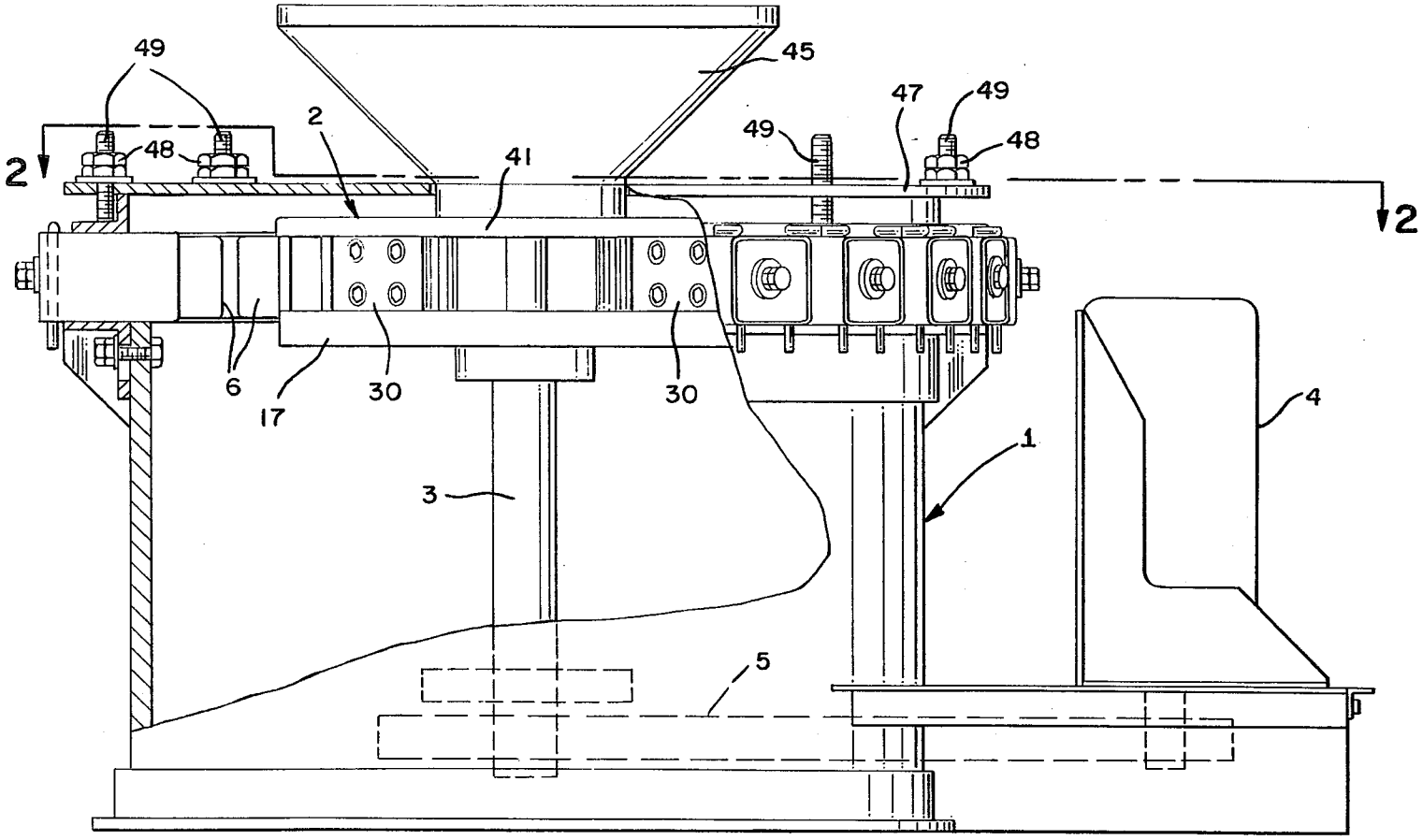
FIG. 1 is a side view of a rock crusher including the impeller assembly of the present invention with portions removed and in cross section.
Figure 2:
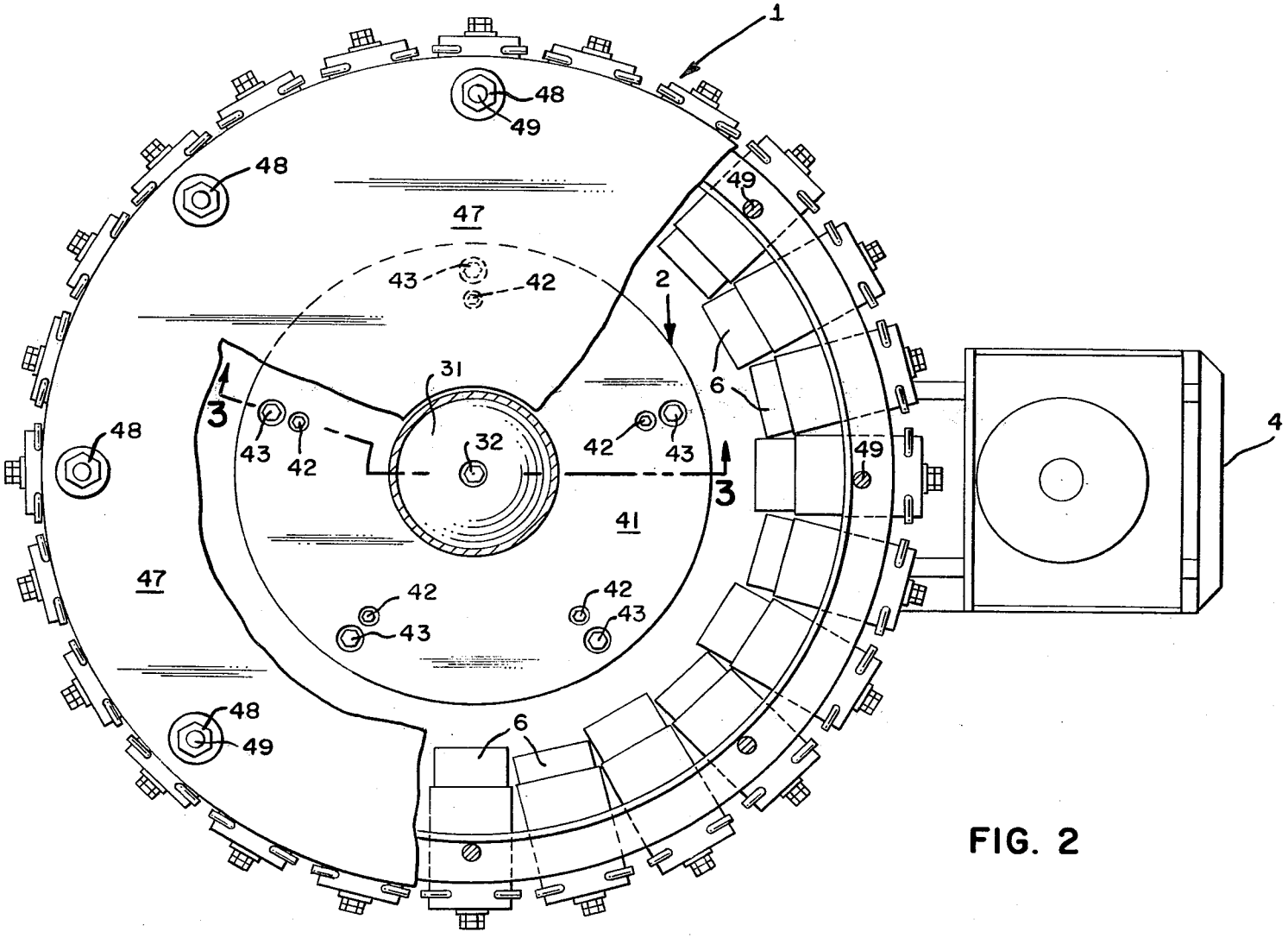
FIG. 2 is a top view of the rock crusher taken along line 2—2 of FIG. 1 with portions removed.

The present invention is for an improvement in a rock crusher 1 generally illustrated in FIGS. 1 and 2 having an impeller assembly 2 mounted on a turntable 17 which is connected to and driven by a vertical drive shaft 3. Such crushers are powered by a motor 4 connected to be drive shaft by means such as belts 5. Breaker blocks 6 surround the impeller. A detailed description of the breaker blocks is set forth in my co-pending patent application entitled *ROCK CRUSHER BREAKER BLOCKS AND ADJUSTMENT APPARATUS,* Transaction Number 270336 executed and mailed May 28, 1981.

One of the key features of the present invention is the replaceable metal wear pin 7 which is best illustrated in FIGS. 5–8. The wear pin is mounted in the impeller and consists of a generally cylindrical portion 8 formed with a projection 9 extending therefrom and terminating in a generally planar end face 10. The pin terminates at both ends in generally planar end faces 11 and 12. Each of the ends of the projections are formed with spaced lug indents 13, 14, 15 and 16.

As shown in FIGS. 5–8, the wear pins are positioned on a peripheral outer band of the impeller in groups of three wherein the projections 9 form a T-shape with the stem of the T located on a radial line and the cross located adjacent the circumference of the impeller. The pin located on the radial is designated as the head pin A and the pins located on the cross are designated as the heel pins $B^1$ and $B^2$.

A standard part of every rock crusher of the present type is a heavy turntable 17 coupled to the vertical shaft by bolts 18. The turntable is carefully machined so that it is balanced and is an expensive component of the crusher. The turntable must be protected from abrasion and it is the most difficult part to remove and to replace. For this reason, the turntable is protected by other parts and in the present invention, the impeller assembly is designed so that it is not necessary to remove the turntable when replacing various wear parts in the impeller assembly.

Figure 8:
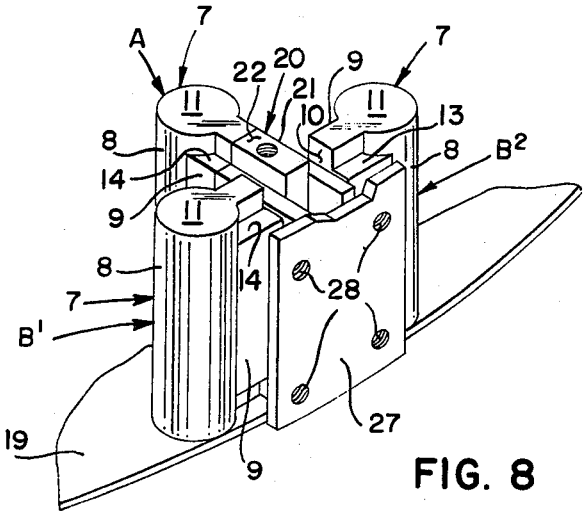
FIG. 8 is a perspective view of the three wear pins of FIGS. 5 and 6 with the full T-structure in place.
Figure 9:
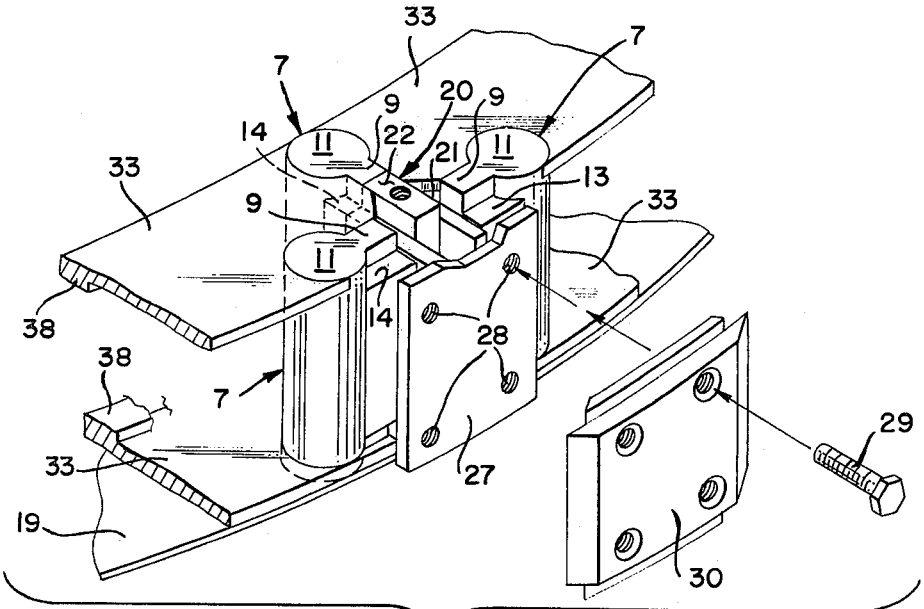
FIG. 9 is a perspective view of the three wear pins of FIGS. 5, 6 and 7 with portions of the adjacent wear plates and the heel wear plate in exploded position.

The key element in the present invention which permits wear parts to be replaced without removing the turntable is the annular impeller tray 19 which is detachably mounted on the turntable. A plurality of T-shaped block members 20 as shown in FIGS. 8 and 9 are connected to the impeller tray as by welding. The sides of the T-shaped members register with the planar end faces 10 of the projection on the wear pins 7. The T-shaped block members may consist of a rectangular member 21 having a top face 22 flush with the top planar end faces 11 of pins 7. Side blocks 23 and 24 with top end faces 25 and 26 flush with lug indents 13 and 14 are connected to rectangular member 21 as by welding. A rear block 27 is connected to side blocks 23 and 24 and is formed with threaded openings 28 for the receipt of bolts 29 for attaching heel wear plates 30.

The center portion of the turntable 17 is protected by landing cone 31 which is releasably connected to vertical shaft 3 by bolts 32. The outer top portion of the turntable and the impeller tray are protected from abrasion by wear plates 33 which are all identical and shaped in arcuate segments with cutout portions 34 and 35 to receive head pins A and cut out portions 36 and 37 to receive heel pins $B^1$ and $B^2$. Preferably the wear plates 33 are formed with a stepped annular ridge 38.

Ends 39 and 40 on wear plates 33 abut projection 9 on head pins A and the sides of side blocks 23 and 24. The upper wear plates 33 are dimensioned to form an annular ring surrounding landing cone 31 and to engage the head pin lugs 13 and 14 and the inner lugs 13 of heel pin $B^1$ and the inner lug 14 of heel pin $B^2$. A lower set of wear plates 33 rest on impeller tray 19. The wear plates 33 interlock with the tops and bottoms of the wear pins.

An annular top cover 41 is detachably connected to each of the T-shaped block members by bolts 42.

The top cover and the entire impeller assembly is releasably connected to turntable 17 by bolts 43.

An annular ring 44 is connected to the rim of turntable 17 and projects upwardly for retaining the rim of impeller tray 19 and a portion of the outer rim of the wear plates 33.

OPERATION

Figure 3:
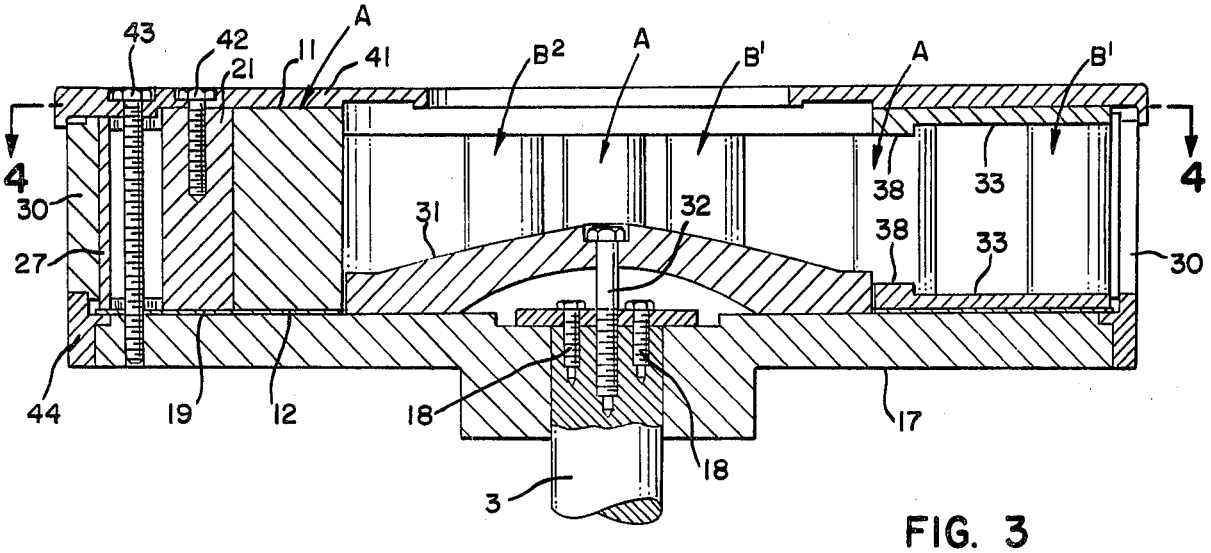
FIG. 3 is a cross sectional view of the impeller assembly taken generally along line 3—3 of FIG. 2.
Figure 4:
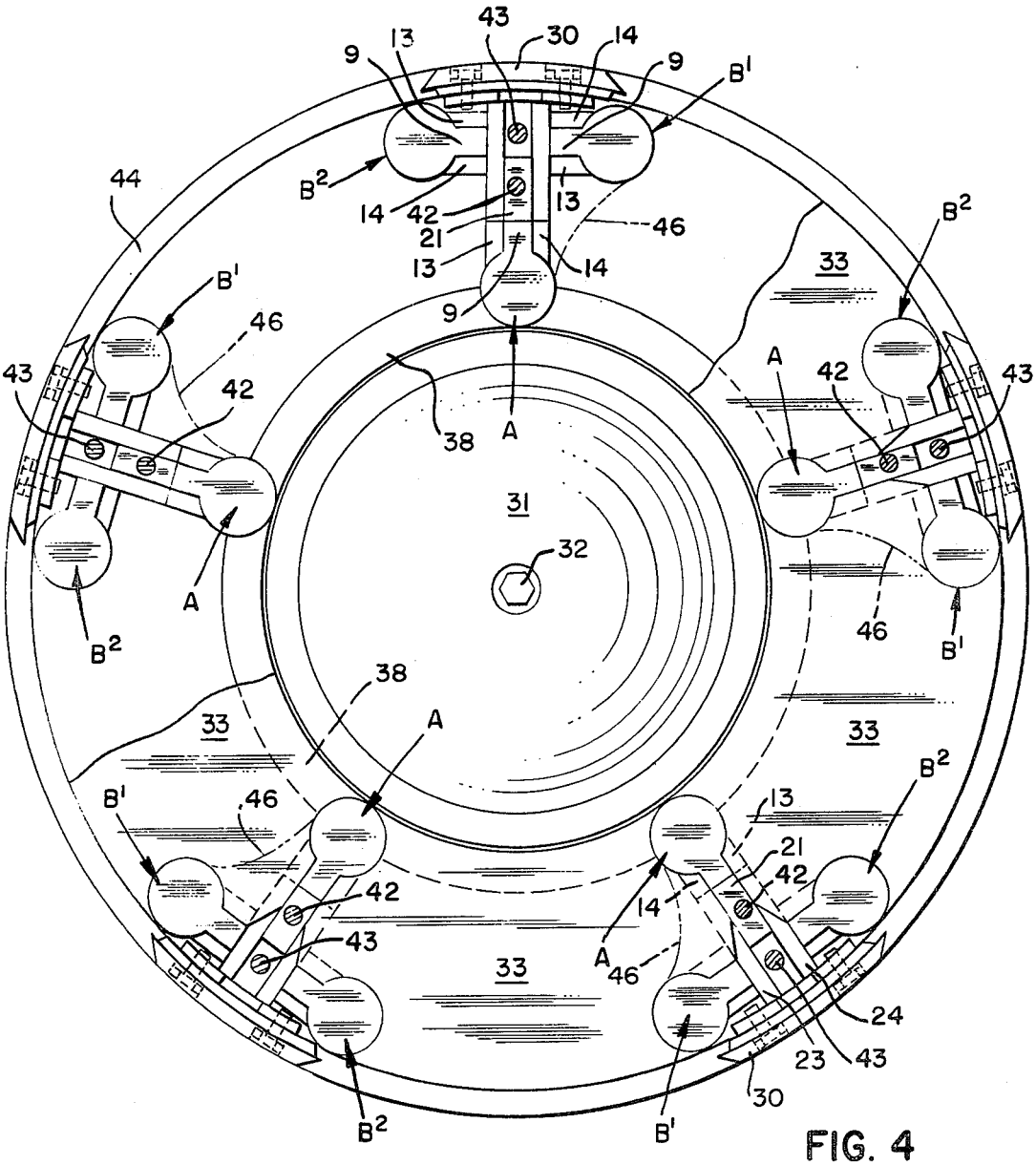
FIG. 4 is a plan view of the impeller assembly taken generally along line 4—4 in FIG. 3 with the top cover removed and portions of the top wear plates removed.
Figure 5:
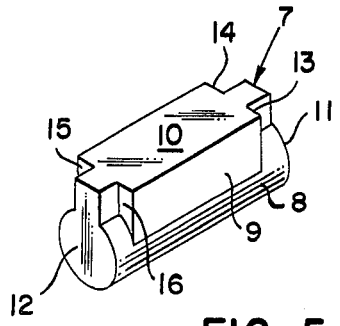
FIG. 5 is a perspective view of a single wear pin.
Figure 6:
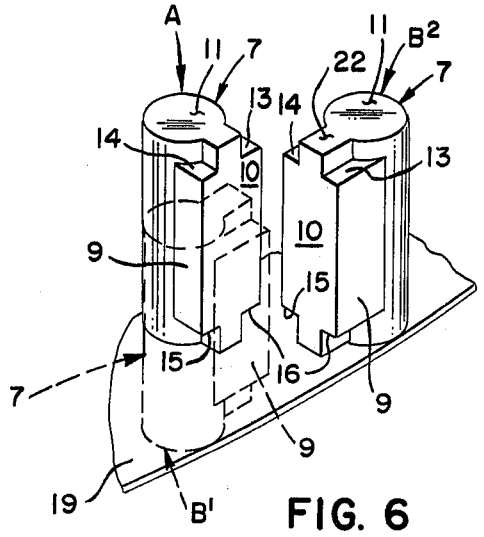
FIG. 6 is a perspective view of three of the wear pins shown in their positions on the removal tray. The pin in the foreground is shown in phantom line for purposes of clarity.
Figure 7:
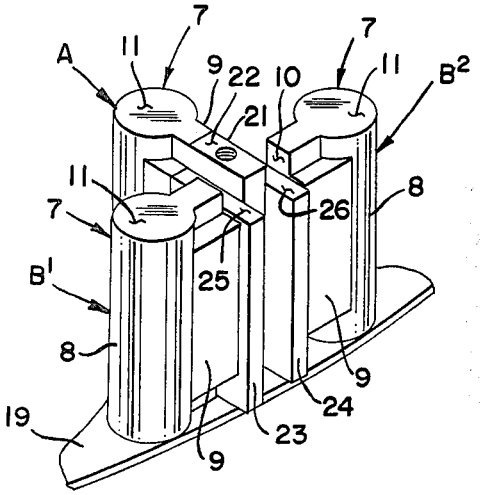
FIG. 7 is a perspective view of the three wear pins of FIG. 5 with a portion of the T-structure in place.
Figure 10:
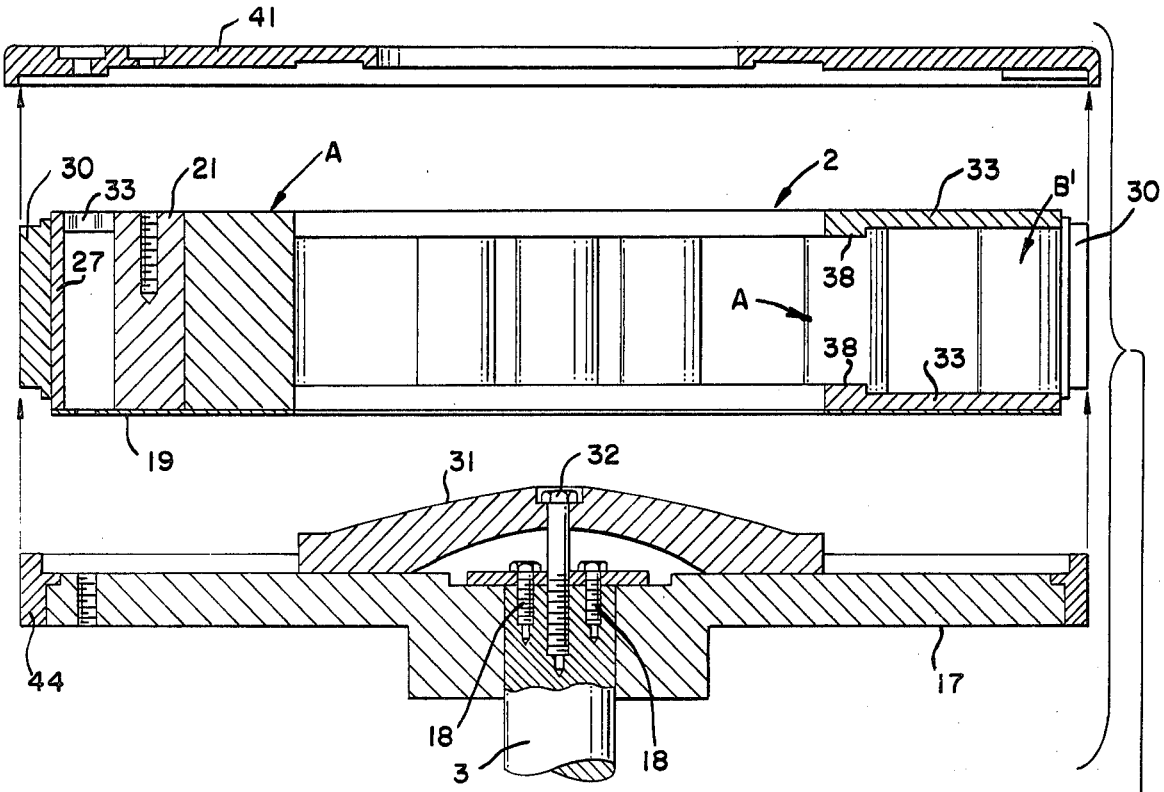
FIG. 10 is a cross sectional view of the impeller shown in FIG. 3 in an exploded view.
Figure 11:
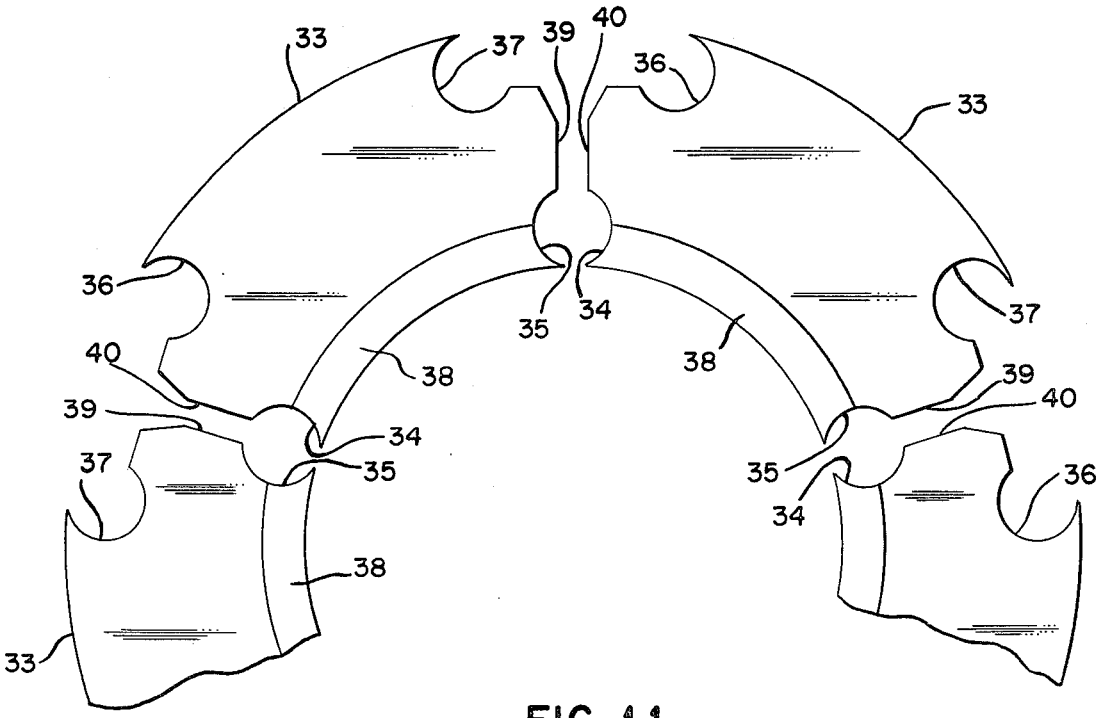
FIG. 11 is a plan view of a portion of the top and bottom wear plates.

The turntable may be rotated either clock-wise or counter-clockwise. Assuming clock-wise operation, feed material enters through cone 45 and lands on landing cone 31. As shown in FIGS. 3 and 10, the landing cone slopes downwardly from its center and the rocks initially move by gravity radially outwardly. The feed material slides across wear plates 33 and picks up rotational speed as it moves radially outwardly. As the machine is operated, small fragments of feed material build up between head wear pin A and a rear pin $B^1$ and fill the space therebetween approximately as shown by dashed line 46. Abrasion of the head pin A and projection 9 occurs but the build up of material between the pins protects the sides of blocks 23 from wear. The feed material slides or rolls across the build up of material along line 46 and is flung at high speed against breaker blocks 6. Some abrasion of heel wear pins $B^1$ occurs, but it has been found that abrasion of the head pin A occurs more rapidly.

After several hours of operation the direction of the turntable may be reversed and abrasion of the other side of head pin A and rear pin $B^2$ takes places. The ability to reverse the direction of the turntable and balance the wear on the wear pins enables the crusher to be operated many more hours before any replacement of parts is necessary.

Since the impeller rim is only a few inches from the breaker blocks, the heel plates 30 are abraded and must be replaced occasionally.

When abrasion of the head pin A or the wear plates 22 advances to the point that continued operation would expose the T-blocks or impeller tray to wear, the machine is shut down and the lid 47 removed by removing nuts 48 from studs 49.

If an inspection reveals that only a single part has prematurely broken or worn out, it may be replaced by simply removing bolts 42 and 43 and the top cover 41 removed. If any of the pins have been broken they may be removed by lifting off the particular top wear plate segments which holds down the lugs of the wear pin and simply lifting out the damaged wear pins. The wear pins are not fastened to the T-blocks 20 or the wear plates by any fastening means other than the mechanical interlocking of the shape of the wear plate members as previously described. A new wear pin may be dropped in place and the wear plates, top plate, and bolts replaced.

In normal operation where several parts must be re-positioned or replaced, only bolts 43 are removed and the entire impeller assembly consisting of the tray 19, pins 7, wear plates 33 and T-blocks 20 and cover 41 are removed from the crusher as a single unit. The heavy turntable 17 and its protective ring 44 are left in the crusher attached to the vertical shaft 3. A new or rebuilt impeller assembly may then be dropped into the crusher, the assembly is attached to the turntable by bolts 43, the lid 47 is replaced and the crusher may be placed back in operation within a very short time. If the landing cone 31 has become worn, it may be replaced at this time by removal of bolt 32. Replacement of the landing cone does not require removal of the turntable. The worn impeller assembly may be taken to a shop area where the worn parts are replaced or repositioned.

Rebuilding the impeller in the shop area is easily and quickly accomplished. The top cover 41 is removed by removing bolts 42. The top wear plates 33 are removed; exposing the wear pins. Since the head wear pin A generally wears faster than the heel pins $B^1$ and $B^2$, the head and the least worn heel pin may be switched. Since the bottom wear plates 33 generally wear faster than the top wear plates, their positions generally may be merely reversed. If it is seen that either the tops or bottoms of most or all of the wear pins are wearing, they may be simply rotated 180° end for end. Thus it may be seen that on many occasions no new parts need be added to the impeller assembly. Rarely will all of the parts need to be replaced. The T-blocks and tray will rarely need replaced unless an operator fails to make a routine inspection and permits wear of either the pins or wear plates to advance too far.

In the event that annular ring 44 which protects the turntable becomes worn, the turntable 17 may be unbolted from the vertical shaft 3 by removing bolts 18. A new rim may be placed on the turnable and returned to service.

I claim:

1. In a rock crusher having an impeller assembly formed with a circumference mounted on a turntable having a rim which is connected to and driven by a vertical drive shaft comprising:

a. a plurality of replaceable metal wear pins mounted in said impeller assembly and each of said pins consists of a generally cylindrical portion formed with a projection extending therefrom and terminating in a generally planar end face and said pins terminate at both ends in generally planar end faces and each end of said projections is formed with a pair of spaced lug indents; and b. said wear pins are positioned on a peripheral outer band of said impeller in groups of three including a head pin and two heel pins wherein said projections form a T-shape having a stem and a cross with said stem of said T located on a radial line and said cross located adjacent said circumference of said impeller, said pin located on said radial line being designated as said head pin and said pins located on said cross being designated as said heel pins.

2. In a rock crusher described in claim 1 comprising:

a. an annular impeller tray detachably mounted on said turntable;

b. a plurality of T-shaped block members connected to said impeller tray in registration with said planar end faces of said projections on said wear pins;

c. a landing cone detachably mounted on said turntable covering the center of said turntable;

d. a plurality of upper and lower wear plates with said lower wear plates dimensioned to substantially form an annular ring having segmented rims surrounding said landing cone and covering said annular impeller tray except for said portions covered by said T-shaped block members and said wear pins;

e. each of said wear plates are formed with a pair of spaced head pin lug engaging areas and a pair of spaced heel pin lug engaging areas;

f. an annular top cover detachably connected to each of said T-shaped block members; and g. means for detachably connecting said top cover and said impeller tray to said turntable.

3. In a rock crusher as described in claim 2 comprising:

a. a metal abrasive resistant heel plate detachably connected to said T-shaped block member.

4. In a rock crusher as described in claim 3 comprising:

a. an annular ring connected to said rim of said turntable and projecting upwardly therefrom for retaining said impeller tray and a portion of said segmented rims of said bottom wear plates.

* * * * *